United States Patent [19]

Pfeifer

[11] B 3,991,639

[45] Nov. 16, 1976

[54] APPARATUS FOR PROTECTING TOOLS OF HYDRAULIC PRESSES

[75] Inventor: Friedrich Pfeifer, Waghausel, Germany

[73] Assignee: SMG Suddeutsche Maschinenbau-Gesellschaft mbH, Germany

[22] Filed: Apr. 23, 1975

[21] Appl. No.: 570,862

[44] Published under the second Trial Voluntary Protest Program on February 24, 1976 as document No. B 570,862.

[30] Foreign Application Priority Data

Apr. 23, 1974 Germany ..... 2419390

[52] U.S. Cl. ..... 83/61; 83/554; 100/53; 192/129 B

[51] Int. Cl.[2] ..... B26D 7/24

[58] Field of Search ..... 83/61, 62, 58, 554; 100/53; 192/129 B

[56] References Cited

UNITED STATES PATENTS 3,568,553 3/1971 Wanner et al. ..... 83/58

*Primary Examiner*—J. M. Meister

*Attorney, Agent, or Firm*—Craig & Antonelli

[57] ABSTRACT

Apparatus for protecting tools of hydraulically operated fine punch presses of the type having a main piston as well as quick-closing pistons for imparting movement to the press ram. Keying pistons are arranged at the ram in series with and extending in the same direction as the quick-closing pistons to form a keying gap, variable in response to resistance pressure applied to the ram movement at or near the closing operation. A safety stop switch is arranged for detecting the keying gap and for effecting a stoppage of the machine in the event the keying gap is below a predetermined amount indicating an impediment in the path of the ram.

4 Claims, 1 Drawing Figure

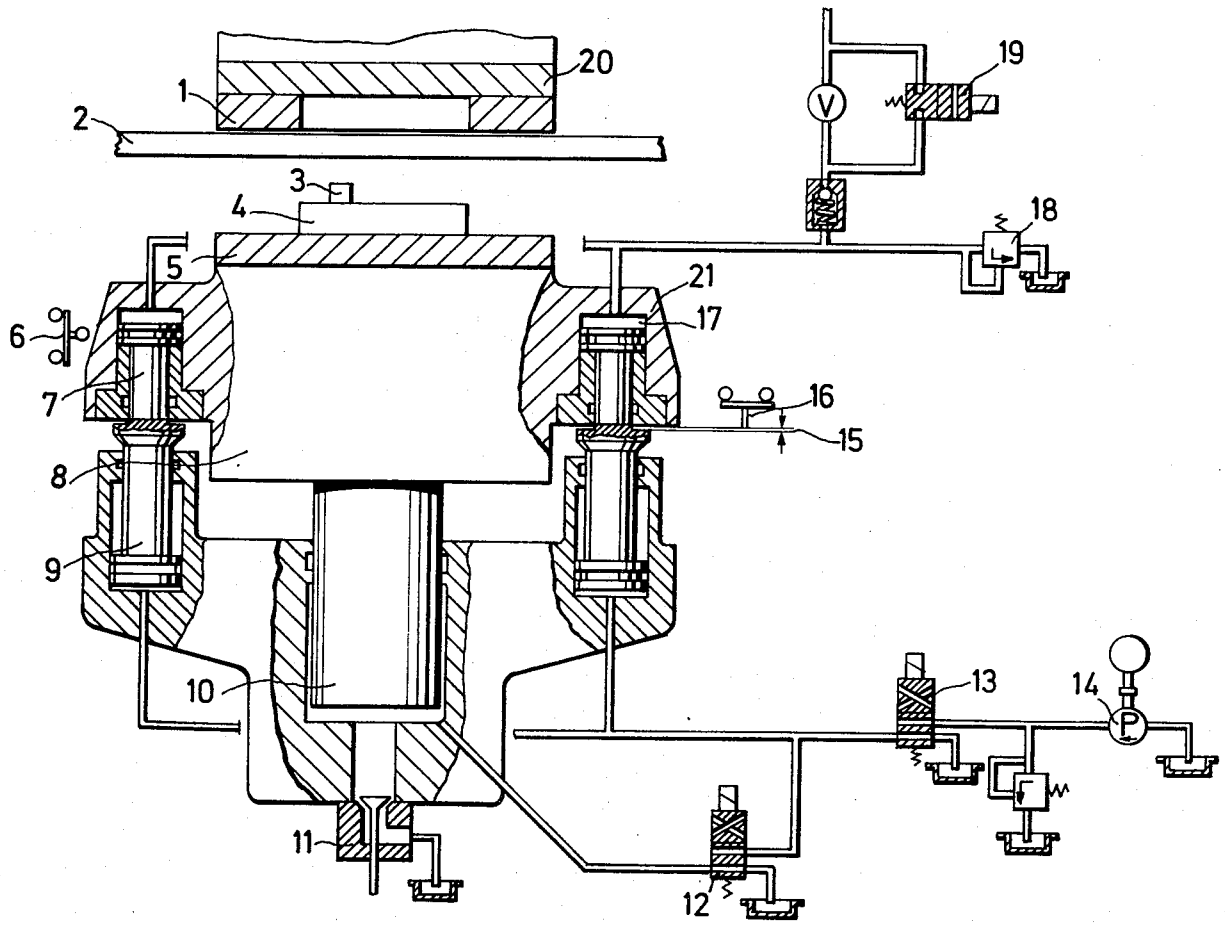
1
2
3
4
5
6
7
8
9
10
11
12
13
14
15
16
17
18
19
20
21

APPARATUS FOR PROTECTING TOOLS OF HYDRAULIC PRESSES

BACKGROUND AND SUMMARY OF THE INVENTION

The present invention relates to punching presses of the type such as disclosed in U.S. Pat. No. 3,107,567. More particularly, the present invention relates to apparatus for protecting the tools of hydraulically operated fine-punch presses for which the closing process is controlled through an end-switch controlled keying gap in the tool or table area and wherein the press table is moved through quick-closing pistons arranged in addition to the main or ram piston means.

It has been contemplated to protect against breaking of tools and fine-punch presses in such a way that a micro-switch is arranged at each of the ram and keying table and that, during movement together of the tool, the keying table is raised by a small amount. During this process, one of the switches is adjusted such that it is operated immediately before the raising of the keying table. If, during operation, the tool is not blown out clean or if the previously punched part has not been thrown out in an orderly fashion, then the second switch, arranged at the keying table, responds before the runner arranged in the ram area during the next stroke. An electronic-electrical control associated with the machine monitors the switching cycle and also controls the mechanical end switches and stops the machines in case of an interference such as mentioned above.

An important disadvantage of the above-described arrangement is that, through the arrangement of the keying unit at the mounting plate for the machine table, the required working or running clearance for same disadvantageously influences the tool guidance so that the quality of the stampings and edge life of the tools are decreased.

In order to avoid the above-noted disadvantages, the present invention contemplates an arrangement including so-called keying pistons connected in series with the quick-closing pistons and extending in the same direction of action. In a preferred embodiment of the present invention, it is further provided that the quick-closing pistons are arranged in the lower crosshead of the press and the keying pistons engage the ram through cantilever sections or the like.

With the arrangement of the present invention, the keying function is shifted (from the table plates as described in the above-noted arrangement) in a pair of quick-closing pistons arranged laterally of the press ram piston whereby the press table and mounting plate remain solidly connected with the major parts of the machine. That is, all machine elements required for the quality of the stampings are free of additional movements needed for protecting the tools against breakage. In other words, with the above-discussed previously contemplated arrangement the supporting press table was moved in order to accommodate the protection of the tools, while in the arrangement of the present invention, the keying pistons and keying gap are arranged at the moving press ram in conjunction with the quick-closing pistons, thereby obviating the necessitating of moving the opposing support table or the like.

A preferred embodiment of the present invention is schematically illustrated in the single drawing FIGURE, which shows a partial, part-sectional view of a press constructed in accordance with the present invention.

The drawing illustration and the present description is limited to those portions of the press necessary for an understanding of the improvement of the present invention. Those skilled in the art, given the present disclosure and the state-of-the-art, such as the above-identified U.S. Pat. No. 3,107,567, will readily be able to practice the invention.

Referring to the drawing illustration, the tool area of a fine-punch press is illustrated, showing an upper part 1, lower part 4 and material strip 2. The press includes an upper table plate 20 as well as lower table plate 5. The lower table plate 5 is solidly connected on ram body 8. Ram body 8 is operatively coupled through the press piston 10 arranged in the lower crosshead 11 for reciprocating movement.

Lateral to the ram body 8, quick-stroke pistons are embedded in the crosshead 11 and further piston 7, constructed as so-called keying plungers, are rested on these quick-stroke or quick-closing pistons 9. Keying cylinders 17, which operatively cooperate with these keying pistons 7 are embedded in cantilever portions 21 arranged laterally at the ram 8.

The operation of the protective apparatus of the invention is as follows. The quick-closing pistons 9 perform the quick-closing movement of the machine ram 8. Keying gap 15 is produced through the arrangement of keying piston 7. If a foreign body 3 lies in the tool space, the driving resistance is increased correspondingly whereby the pressure in the hydraulic fluid in the cylinder chamber 17 likewise increases. The hydraulic fluid or oil is displaceable through valves 18. The keying gap 15 is reduced upon an increase in the pressure in chamber 17 such that end switch 16 is operated before end switch 6. In this case, the electrical control system registers a fault and stops the machine. On the other hand, assuming no impediment or other foreign substance 3 in the tool space, with no consequent high pressure in chamber 17, switch 6 is positioned so as to operate before the operation of end switch 16, with such a sequence of operation of the switches indicating that no fault exists and that the punch process is free to proceed.

In the drawing, reference numerals 12, 13, 14 and 19 depict the hydraulic circuitry for actuating the main ram piston 10, as well as the quick-closing and control pistons.

While I have shown and described one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

What I claim is:

1. Tool protecting apparatus for protecting tools of hydraulically operated fine-punch presses of the type having main piston means for imparting primary punching movements to a movable press ram and quick-closing piston means arranged at the ram separate from the main piston means for imparting final punching movement to said ram; said apparatus comprising:

keying piston means arranged at said ram in series with and extending in the same direction as the quick-closing piston means, said keying piston means forming a keying gap which is variable in size depending on the resistance pressure applied to the ram by the workpieces being processed and impediments disposed between the workpieces and the ram whereby said keying gap is reduced below a predetermined distance when undersirable impediments above a certain size and rigidity are disposed in the travel path of the ram, and safety stop switch means operable to stop application of pressing forces to said press ram in response to closing of said gap below said predetermined value.

2. Apparatus according to claim 1, wherein said quick-closing piston means includes a plurality of separate quick-closing pistons connected with respective keying pistons of said keying piston means, and wherein fluid chamber spaces are formed at the respective opposite end faces of the quick-closing and keying pistons.

3. Apparatus according to claim 2, wherein said gap is formed between said ram and a shoulder on one of said quick-closing and keying pistons.

4. Apparatus according to claim 1, wherein said main piston means are supported at a lower crosshead of the press, wherein said quick-closing piston means includes a plurality of separate quick-closing pistons arranged in the lower crosshead spaced laterally of said main piston means in alignment with respective keying pistons of said keying piston means, and wherein said keying pistons are arranged in cantilever portions of said ram spaced laterally of pressing tool areas of the ram.

* * * * *